US005407008A

United States Patent [19]

Boloix

[11] Patent Number: 5,407,008

[45] Date of Patent: Apr. 18, 1995

[54] VERTICAL BLINDS CARRIER ASSEMBLY

[76] Inventor: Jose A. Boloix, 3211 NW. 16 Ter., Miami, Fla. 33125

[21] Appl. No.: 125,710

[22] Filed: Sep. 24, 1993

[51] Int. Cl.[6] ..... E06B 9/38

[52] U.S. Cl. ..... 160/177

[58] Field of Search ..... 160/177 V, 176.1 V, 160/168.1 V, 900, 172 V, 173 V, 178.1 V

[56] References Cited

U.S. PATENT DOCUMENTS

| | | | |
|---|---|---|---|
| 2,807,322 | 9/1957 | Toti | 160/176.1 V X |
| 4,559,670 | 12/1985 | Wyatt | 160/177 V X |
| 4,616,688 | 10/1986 | Agos | 160/176.1 V X |
| 4,628,981 | 12/1986 | Ciriaci et al. | 160/176.1 V |
| 4,736,784 | 4/1988 | Boloix . | |
| 4,799,527 | 1/1989 | Villoch et al. | 160/168.1 |
| 4,834,163 | 5/1989 | Dickstein | 160/177 V X |
| 5,022,453 | 6/1991 | Rozon | 160/168.1 V |
| 5,249,617 | 10/1993 | Durig | 160/176.1 V X |
| 5,291,946 | 3/1994 | Ciriaci | 160/177 V |

*Primary Examiner*—David M. Purol
*Attorney, Agent, or Firm*—J. Sanchelima

[57] ABSTRACT

A louver holding carrier for vertical blind assemblies are slidably mounted within a track along which a rotably driving shaft passes through the carrier and imparting rotation to a worm gear assembly that in turn causes the sprocket termination of a louver holder to rotate. The sprocket termination has teeth over an arc of more than 90 degrees and less than 150 degrees in order to facilitate the jump of the meshed engagement between the worm gear assembly and the sprocket termination without jamming. A stopper member limits the rotation of the louver holding assembly.

2 Claims, 2 Drawing Sheets

VERTICAL BLINDS CARRIER ASSEMBLY

BACKGROUND OF THE INVENTION

1. Field of the Invention

The present invention relates to a carrier assembly, and more particularly, to those carrier assemblies that permit the alignment of the louvers being carried.

2. Description of the Related Art

Applicant believes that the closest reference corresponds to U.S. Pat. No. 4,736,784 issued to this applicant on Apr. 12, 1988. However, it differs from the present invention because the problem was addressed and attempted to be resolved through a substantially different mechanism.

Other patents describing the closest subject matter provide for a number of more or less complicated features that fail to solve the problem in an efficient and economical way. None of these patents suggest the novel features of the present invention.

SUMMARY OF THE INVENTION

It is the primary object of the present invention to provide a carrier for vertical blinds that permits the alignment of the louvers it carries by simply continuing to turn the driving tube and causing the louver holder to slip after it reaches the maximum rotating position.

It is another object of the present invention to provide a carrier where the louver holder can be rotated between two positions without causing it to jam.

It is a further object of the present invention to provide a carrier that is reliable.

It is still another object of the present invention to provide a carrier that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
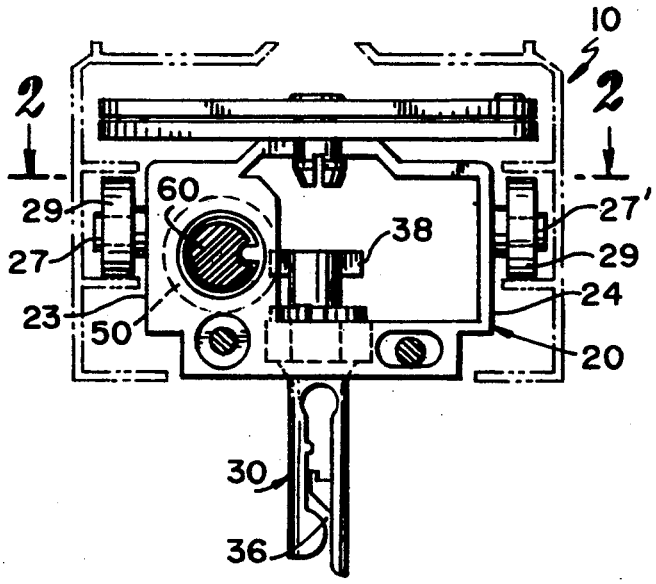
FIG. 1 is an elevational view of a carrier incorporating the features of the present invention and showing the track assembly through which the carrier moves in phantom.

Referring now to the drawings, where the present invention is generally referred to with numeral 10, it can be observed that it basically includes a housing 20 defining a space with a substantially rectangular cross-section. The housing 20 includes top wall 21, front wall 23, rear wall 24, and lateral walls 25 and 26. In addition, the housing 20 includes front and rear shafts 27 and 27' that are rigidly mounted to front and rear walls 23 and 24 to which wheels 29 are rotably mounted.

Figure 2:
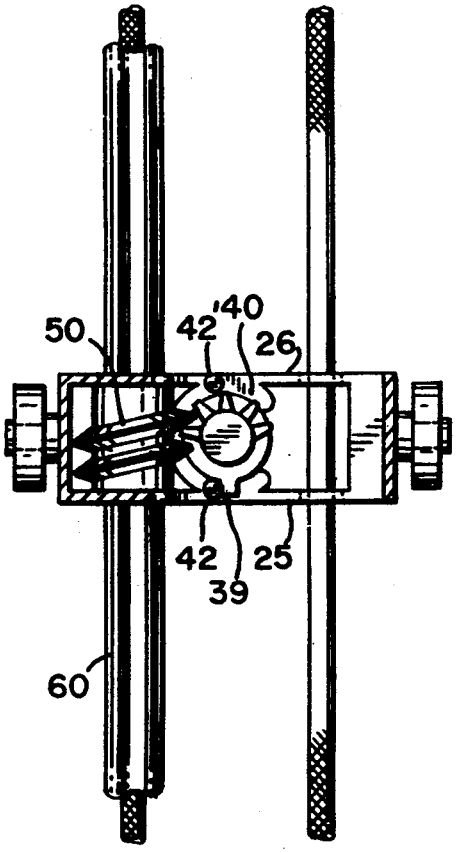
FIG. 2 is a cross-sectional view taken along line 2—2 in FIG. 1.
Figure 3:
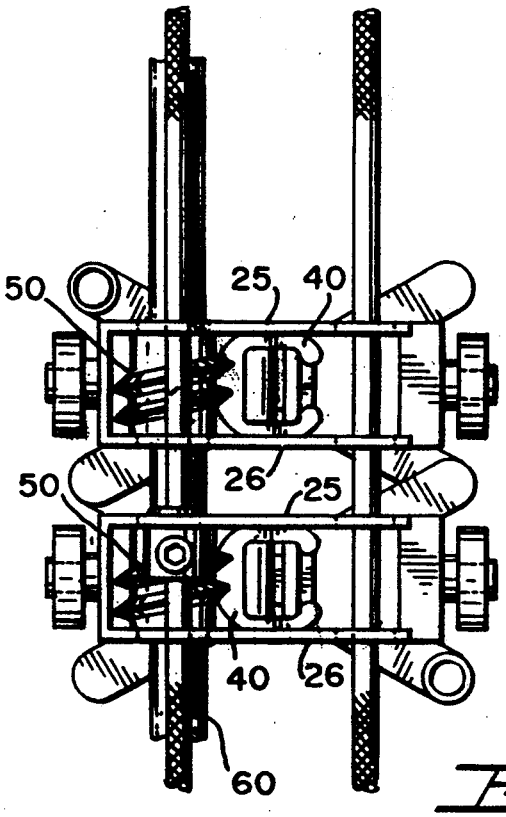
FIG. 3 is a bottom view showing two carriers wherein the lowermost carrier is the end carrier of a given assembly.
Figures 4, 5:
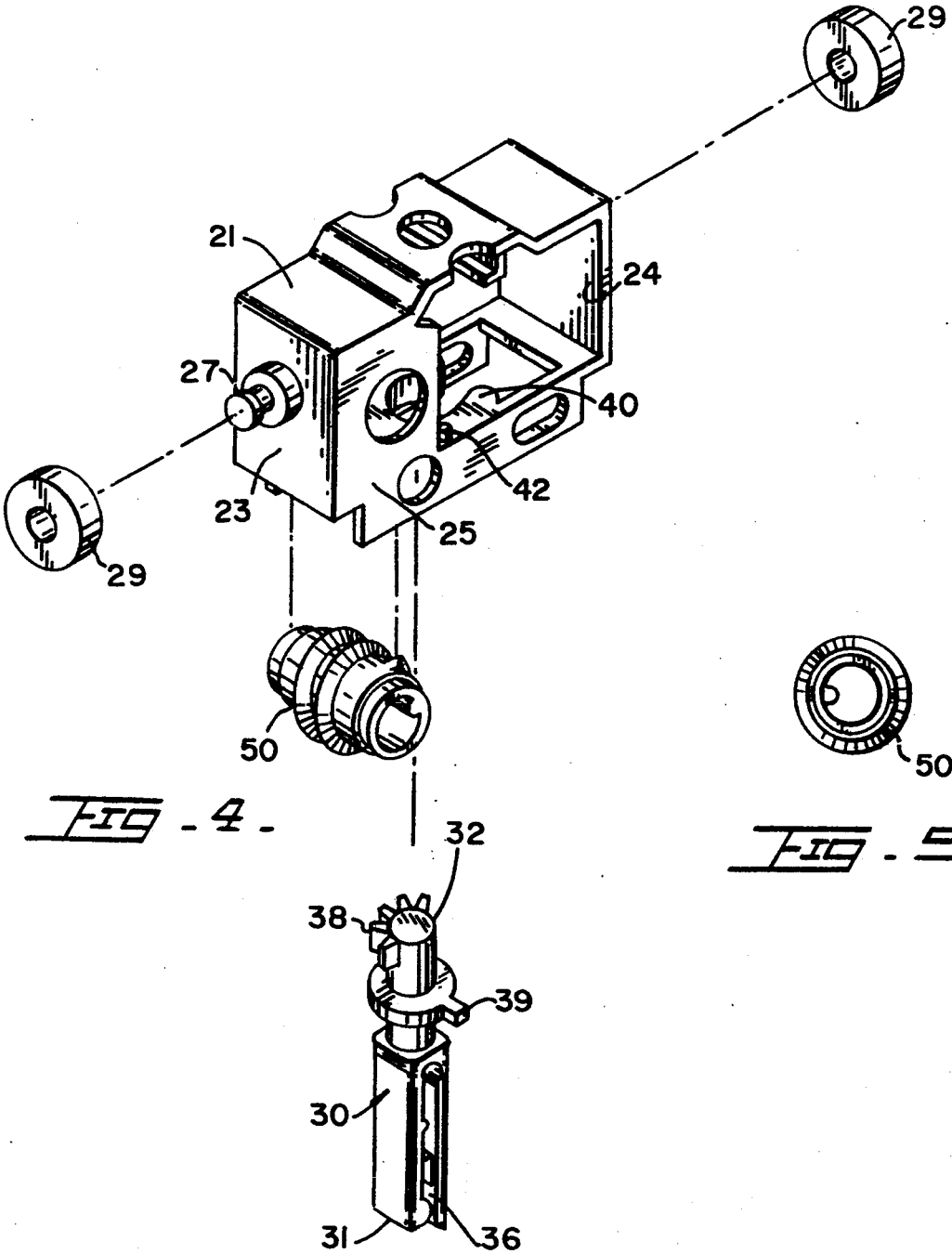
FIG. 4 is a representation of an exploded isometric view of the present carrier showing its main components.
FIG. 5 is a top view of the worm gear.

FIG. 1 discloses a louver holder assembly 30 which is rotably supported by a C-shape bearing member 40 which is rigidly mounted to inner face of lateral walls 25 and 26 of housing 20. The louver holder assembly 30 has two ends 31 and 32, end 31 corresponding to a clip 36 for engaging and holding the louvers (not shown) and the second end 32 having a sprocket termination 38. As shown in FIG. 1, the sprocket termination 38 is in a meshed engagement with worm gear 50. The sprocket termination 38 has teeth which are limited to only one section perimeter, ranging from a minimum angle of 90 degrees to a maximum angle of 150 degrees as it can be best seen in FIG. 2.

The worm gear 50 is rotated by a driving shaft 60 which in turn is rotated by a user through conventional means. In addition, worm gear 50 causes sprocket termination 38 to rotate until it reaches a predetermined position at which point the louver holder is stopped by stopper members 42 and 42', located inside housing 20. Stopper members 42 and 42' are rigidly positioned on the upper side of C-shape bearing member 40 and cooperatively comes in contact with pin 39 which is rigidly mounted to the louver holder assembly 30 at a position just below sprocket termination 38. Thus, the rotation of louver assembly 30 is limited due to the configuration of sprocket 38 having sufficient teeth to make assembly 30 to rotate between 90 degrees and 150 degrees. Stopper member 42 and 42' ensure that sprocket termination 38 does not go beyond the singular limits.

In a preferred embodiment, once pin 39 of the louver assembly 30 comes in contact with stopper member 42 or 42', any additional rotation transmitted by worm gear 50 causes sprocket termination 38 to jump the meshed engagement with worm gear 50. When the sprocket termination 38 has been rotated until there is only one tooth remaining, sprocket termination 38 jumps after it reaches the predetermined maximum position dictated by the position of the stopper member 42. There are virtually no opportunities for causing the device to jam, even if driving shaft 60 continues to rotate. The jamming of other designs is traced to the sprocket mechanism meshed with the worm gear since the multiple teeth that follow prevent louver assembly 30 from detaching itself and jumping the additional rotation that is not needed after the louver for a particular carrier has been aligned.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A louver holding carrier for vertical blind assemblies including a track through which said carriers are slidably mounted and having a rotatable driving shaft passing through said carrier, comprising:

A. housing means having front and end walls including each a wheel assembly mounted thereon for sliding over said track;

B. a worm gear means engagedly mounted to said driving shaft;

C. louver holding means rotably mounted to said housing having a sprocket termination means having a plurality of teeth contiguously positioned over an arc of between 90 degrees and 150 degrees and said teeth in engagement with said worm gear means; and D. means for stopping the rotation of said louver holding means to a rotation angle between 90 degrees and 150 degrees wherein said means for stopping the rotation of said louver holding means includes first and second pin members rigidly mounted to said housing so that said louver holding means rotates for an arc of approximately 150 degrees.

2. The louver holding carrier apparatus of claim 1, wherein said housing means includes a C-shaped bearing member mounted inside said housing means and said bearing member adapted to rotably support said louver holding means.

* * * * *